US005829802A

United States Patent [19]

Anderson et al.

[11] Patent Number: 5,829,802

[45] Date of Patent: Nov. 3, 1998

[54] MULTI-POINT LOCK OPERATOR FOR CASEMENT WINDOW

[75] Inventors: Todd Allan Anderson, Conyngham; Clifford Elliott Simon, Mountaintop; Edward J. Subliskey, Mountaintop; Jeffrey M. Briggs, Mountaintop, all of Pa.

[73] Assignee: Allen-Stevens Corp., West Hazelton, Pa.

[21] Appl. No.: 876,336

[22] Filed: Jun. 16, 1997

[51] Int. Cl.[6] ..... E05B 3/00

[52] U.S. Cl. ..... 292/336.3; 292/139

[58] Field of Search ..... 292/36, 139, 158, 292/161, 336.3, DIG. 33

[56] References Cited

U.S. PATENT DOCUMENTS

| | | | |
|---|---|---|---|
| 3,993,338 | 11/1976 | Cherbourg et al. | 292/336.3 |
| 4,025,096 | 5/1977 | Geer | 292/139 |
| 4,674,777 | 6/1987 | Guelck . | |
| 4,828,299 | 5/1989 | Poe | 292/139 |
| 5,118,145 | 6/1992 | Tucker . | |
| 5,318,333 | 6/1994 | Dreifert . | |

*Primary Examiner*—Steven N. Meyers
*Assistant Examiner*—Tuyet-Phuong Pham
*Attorney, Agent, or Firm*—Hill & Simpson

[57] ABSTRACT

An operator for a multi-point locking system for a casement window is provided. The operator includes a handle having two opposing legs that pass through side walls in the escutcheon thereby leaving the outer wall of the escutcheon intact. Due to a delay between movement of the handle and the first link which indirectly imparts movement of the handle to the tie bar, the handle can be rotated a full 180° between the open and the closed positions while the first link is rotated through an angle of less than 180°. As a result, the handle lies in a flat position with respect to the inside window frame surface in both the open and closed positions. Because of the handle design which employs two opposing legs disposed on opposite sides of the escutcheon, the operator can be used both on the right side and the left side of a window frame. The legs of the handle include inwardly extending shafts which are accommodated and supported by braces disposed on opposing sides of the base. The shafts of the legs of the handle engage the braces and arches disposed on the slots the sidewalls of the housing through which the shafts pass to provide a series of tongue-in-groove relationships which provide structural stability to the connection between the legs and the escutcheon and an effective seal between the handle, escutcheon and base of the operator.

20 Claims, 5 Drawing Sheets

107
87
91
83
75b
78
111
25
46
112
75
75a
59
52
44
45
10
16a 25
16a
10
43
11
104
44
52
45
51
75a
106
111
16
46
112
75b
59
75

FIG. 6
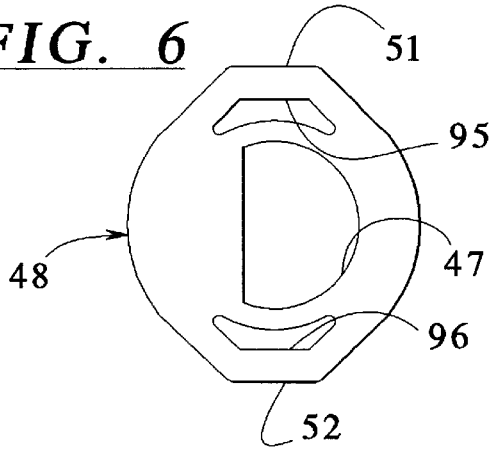
FIG. 7
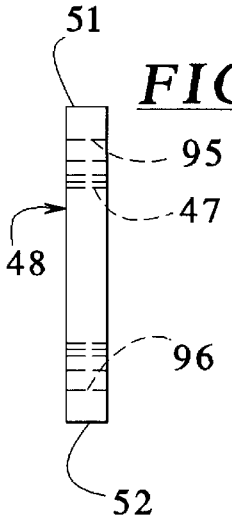
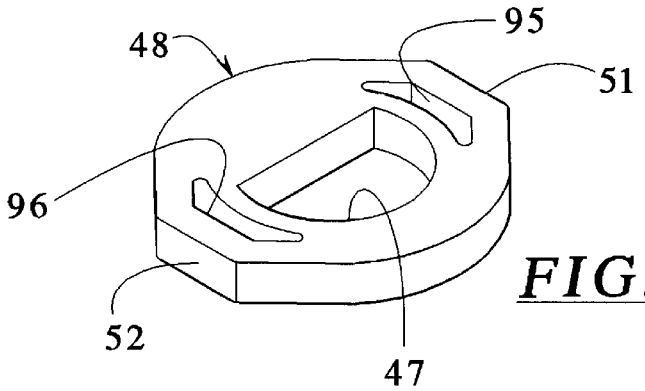
FIG. 5
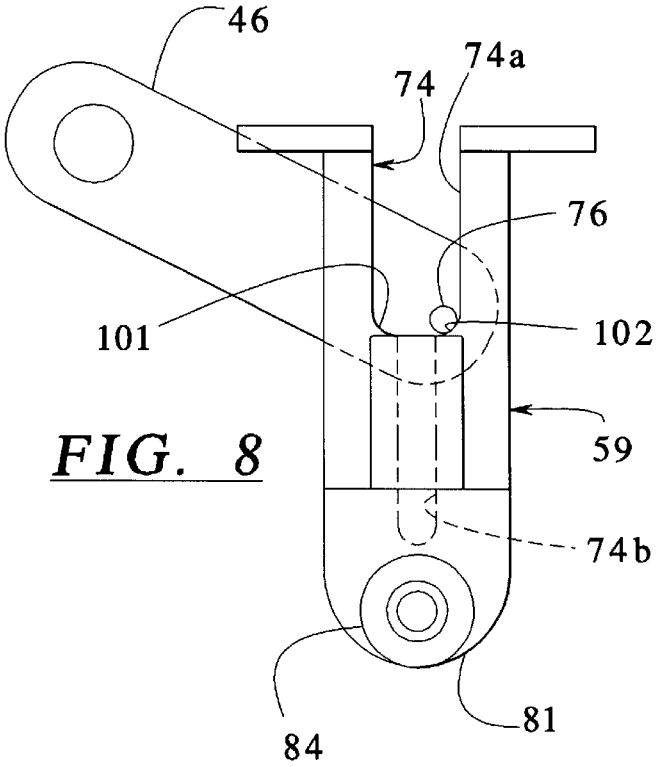
FIG. 8

MULTI-POINT LOCK OPERATOR FOR CASEMENT WINDOW

BACKGROUND OF THE INVENTION

The present invention relates generally to window locks and, more particularly, to window locks for casement windows. Still more specifically, the present invention relates to multi-point window locks for casement windows designed for a multi-point lock-up of a window sash against a window frame.

Casement windows are generally provided with one of two types of locks—a single point lock, also known as a cam lock, and a multi-point lock. Single-point locks typically provide a single hook structure which interacts with a keeper on the window frame to hold the sash against the frame. However, casement window sashes are susceptible to warping or deformation. As a consequence, single-point locks, which typically lock the sash to the frame at a middle point on the window sash, cannot compensate for warping of the casement window at either the top or the bottom of the window.

To address the warping problem, window lock manufacturers developed the multi-point lock. In a multi-point lock, a plurality of keepers are mounted on the window sash. The window is locked by moving a tie bar, which includes one roller for each keeper, into a locked position whereby each roller has engaged a keeper. By spacing the keepers along the length of the window, the engagement between the rollers and the keepers effectively pulls a warped or bent sash against the window frame. To alleviate problems associated with severely warped windows, sequential locking systems have been developed whereby the rollers engage the keepers one at a time and sequentially from the bottom of the window towards the top of the window. As a result, the warped upper part of the window is gradually pulled inward toward the frame as the window is locked. An example of a sequential multi-point locking system is illustrated in U.S. Pat. No. 4,991,886.

Further, multi-point lock systems have been developed which can be used with a variety of sash configurations and dimensions. Essentially, these "universal" locks provide an additional link disposed between the lock operator and the tie bar. Because the additional link is pivotally connected to both the tie bar and the lock operator, it can be used with a variety of window sash dimensions. An example of a universal multi-point window lock is shown in U.S. Pat. No. 5,118,145.

However, one problem associated with currently-available multi-point lock systems is that the lock systems are designed with a handle disposed on the right side of the escutcheon or the left side of the escutcheon. While some locks are intended to be used on a particular side of a window sash, if two operators are positioned side-by-side between two windows, they look awkward if the handles of both operators are connected to the same side (i.e. right or left) of the escutcheon. Accordingly, there is a need for a multi-point lock operator with a truly symmetrical appearance which can be used on either side of a window sash.

Further, in order for currently-available multi-point lock operators to be provided with a biasing spring to bias the operator into either a locked or unlocked position, the escutcheon must be enlarged to accommodate the spring. These "high profile" escutcheons are not preferred by consumers who demand that window and door hardware be discreetly designed and less noticeable. For those operators that do not include a biasing spring, in the open or unlocked position, the handle can pivot out of place toward the closed or locked position thereby preventing closure of the window sash.

Still further, in a typical multi-point lock design, two links are disposed between the tie bar and the handle. One link connects the handle to a second link which, in turn, provides the connection to the tie bar. For most available designs, the link that is connected to the handle cannot pivot a full 180° without engaging the underside of the escutcheon. Accordingly, the handle cannot pivot a full 180°. As a result, in the open or unlocked position, the handle is not disposed in a parallel relationship to the window frame, but extends outward from the sash. This position is both unsightly and further enables the handle to fall downwards toward the closed or locked position due to the lack of any biasing force keeping the handle in the open or unlocked position. For those designs that do permit a full 180° of handle movement, the escutcheon is enlarged and extends outward from the wall to accommodate the movement of the underlying link. The designs with escutcheons and handles that extend outward from the frame or wall are not preferred because they interfere with the operation of the curtain, blind or window treatment.

Still further, in many cases, a multi-point operator is employed along a casement window directly above a single-point operator for a shorter or smaller window. Hence, the single-point and multi-point operators may be disposed directly above or directly below one another on a wall. Unfortunately, the escutcheon and handle configurations for single point operators typically look much different than the escutcheon and handle configurations for multi-point operators. Consumers and interior designers would much prefer to have a single escutcheon and handle design for both single and multi-point operators that not only looks the same, but that is indistinguishable.

Accordingly, there is a need for an improved multi-point lock operator design which includes a biasing force to keep the lock in both the closed and open positions, which further permits the handle to rotate a full 180° so that the handle is disposed adjacent and parallel to the inside surface of the window frame when the lock is in both the locked and unlocked positions which looks similar or substantially indistinguishable from a single-point operator from the inside of the structure and which presents a low profile on the inside surface of the window frame.

SUMMARY OF THE INVENTION

The present invention provides an improved multi-point lock system that satisfies the aforenoted needs. Specifically, a sash lock is provided whereby the handle is disposed adjacent to and parallel to the inside surface of the window frame in both the locked and unlocked positions, a biasing force biases the handle into both the locked and unlocked positions and, the lock is equally suitable for use on both the right side and left side of a window frame.

More particularly, the present invention provides a sash lock which includes a base consisting of an elongated frame that defines a central slot. The frame further includes a pair of parallel side members disposed on opposing sides of the slot. Each side member includes a brace for supporting the handle during pivotal movement of the handle between an open and a closed position. Each side member further includes a track for supporting and guiding the sliding movement of a plate member.

The handle includes a pair of opposing legs, each opposing leg includes a distal end having an inwardly extending shaft that is supported by one of the braces. At least one of the shafts is connected to the proximate end of a first link that extends through the central slot of the frame. The first link includes a distal end that is equipped with a pair of outwardly extending sliders. The distal end of the link is accommodated between the walls of a dual-walled plate member with the sliders being accommodated in a downwardly extending slot disposed in each wall. A proximate end of the plate member includes a pair of outwardly directed ledges which are accommodated in one of the tracks of the side members of the frame. The dual-walled plate member also includes a distal end that is pivotally connected to a second link. The second link is connected to a tie bar.

In an embodiment, the frame member includes at least one bracket for connecting the frame to the escutcheon. The escutcheon is disposed between the opposing legs of the handle whereby the inwardly extending shafts of the opposing legs of the handle extend through side walls of the escutcheon.

In an embodiment, the lock further includes a washer that is mounted onto the shaft of the leg of the handle that is connected to the first link. The washer includes an outer periphery featuring two diametrically opposed flat surfaces. One of the flat surfaces engages in underside of the escutcheon and biases the lock into an open or unlocked position, the other flat surface engages the underside of the escutcheon and biases the lock into a closed or locked position.

In an embodiment, slots are provided in side walls of the escutcheon which accommodate inwardly extending shafts of the opposing legs of the handle. In an embodiment, the slots disposed in the side walls of the escutcheon include a downwardly extending tongue which is accommodated in a groove disposed in each shaft of each leg of the handle thereby providing a tongue-in-groove fit which provides structural stability for the legs of the handle and a suitable seal.

In an embodiment, each brace also includes an upwardly extending tongue structure which is accommodated in a groove disposed in each shaft of each leg of the handle to provide a similar tongue-in-groove engagement for providing structural stability for the legs of the handle and a suitable seal.

In an embodiment, the shaft of the leg that is connected to the first link includes a cammed outer peripheral surface which includes at least one flat surface and the proximate end of the link that is connected to the shaft includes a non-circular hole through which the shaft passes. A clearance is provided between the non-circular hole of the first link and the shaft of the leg that passes through the hole. Because of this clearance, rotation of the handle thereby causes a delayed engagement between the flat surface of the shaft and the hole of the link thereby resulting in a delayed rotation of the first link and permitting an initial rotation of the handle without any rotation of the first link.

In an embodiment, the shaft of the leg of the handle that is connected to the proximate end of the first link includes a semi-circular cross section while the proximate end of the first link includes a non-circular hole which provides a clearance between the cross section of the shaft and the hole. The clearance results in a delayed rotation of the first link after rotation of the handle.

In an embodiment, each slot disposed in each wall of the dual-walled plate member comprises a wider upper end and a narrower lower end. At the transition between the wider upper end of the slot and the lower narrower end of the slot is disposed to curved receiving areas disposed on either side of the slot. These curved receiving areas provide an effective interference against movement of the plate member from the locked position downward along the base of the operator toward an open position when a force is imposed directly on the dual-walled plate member from outside the window. Specifically, if the operator is in a closed position, and an intruder inserts a tool or blade between the sash and frame from the outside and attempts to impose a downward force on the dual-walled plate member, the slider of the link will catch in the curved receiving area disposed between the wider upper portion of the slot and the lower narrower portion of the slot. This interference caused by the curved receiving area will prevent further downward movement of the dual-walled plate member towards the open position. Hence, the interference between the curved receiving area and the slider of the first link contributes to the "pick-proof" characteristics of the multi-point lock operator of the present invention.

In an embodiment the base of the lock further comprises two mating halves, each half consisting of one half of the frame, one of the braces and including one of the tracks.

In an embodiment, the dual-walled plate member further comprises four ledges, two ledges being disposed on top of each wall and two of the ledges being disposed in each of the tracks of the base.

In an embodiment, the handle further comprises a grip member that connects the proximate ends of the opposing legs of the handle. In a closed or locked position, the grip is disposed in a position substantially parallel to the base and adjacent to the inside surface of the window frame and, in an open or unlocked position, the grip is also disposed in a position substantially parallel to the base and adjacent to the inside surface of the window frame.

In an embodiment, the appearance of the escutcheon and handle of the multi-point lock operator of the present invention is substantially identical or substantially indistinguishable from the appearance of a handle and escutcheon of a single-point lock operator.

In an embodiment, the handle of the multi-point lock rotates approximately 180° while the first link rotates approximately 160°.

It is therefore an advantage of the present invention to provide an improved multi-point lock operator for casement windows that has a low profile in both the unlocked and locked positions.

Yet another advantage of the present invention is to provide an improved multi-point lock operator for a casement window that permits a full 180° rotation of the handle.

Another advantage of the present invention is to provide an improved multi-point lock operator for a casement window that permits a full 180° rotation of the handle which results in a less than 180° rotation of the link that is connected to the handle.

Yet another advantage of the present invention is to provide an improved multi-point lock operator for a casement window that is biased into an unlocked position and biased into a locked position.

Yet another advantage of the present invention is to provide an improved multi-point lock operator for a casement window that can fit a variety of window shapes, styles and sizes.

Another advantage of the present invention is to provide an improved multi-point lock operator for a casement window that provides an effective seal against the inside surface of the window frame.

Another advantage of the present invention is that it provides an improved multi-point lock operator having an escutcheon and handle appearance from the inside of the structure that is substantially the same or substantially indistinguishable from the appearance of the handle and escutcheon design of an accompanying single point lock operator.

Still another advantage of the present invention is to provide an improved multi-point lock operator for a casement window that can be used on either side of a window frame and that eliminates the need to manufacture and stock both right-handed and left-handed operators.

And, another advantage of the present invention that it provides an improved multi-point lock operator that is substantially pick proof in that the sliders of the first link are caught in curved receiving areas disposed between a wider upper portion of the slot disposed in the dual-walled plate member and the lower narrower portion of the slot disposed in the dual-walled plate member. The interference between the sliders of the link and these curved receiving areas provide resistance against an intruder inserting a blade or tool between the sash and the window frame from outside of the building or structure in an attempt to pick the lock.

Other objects and advantages of the invention will become apparent upon the reading the following detailed description and appended claims, and upon reference to the accompanying drawings.

BRIEF DESCRIPTION OF THE DRAWINGS

For more complete understanding of this invention, reference should now be made to the embodiments illustrated in greater detail in the accompanying drawings and described below by way of an example of the present invention.

In the drawings:

FIG. 5 is a perspective view of a washer of the multi-point lock operator shown in FIG. 1;

FIG. 6 is a top plan view of the washer shown in FIG. 5;

FIG. 7 is an end view of the washer shown in FIG. 5;

FIG. 8 is an elevational view of the first link and plate member of the multi-point lock operator shown in FIG. 1.

It should be understood that the drawings are not necessarily the scale and that the embodiments are illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
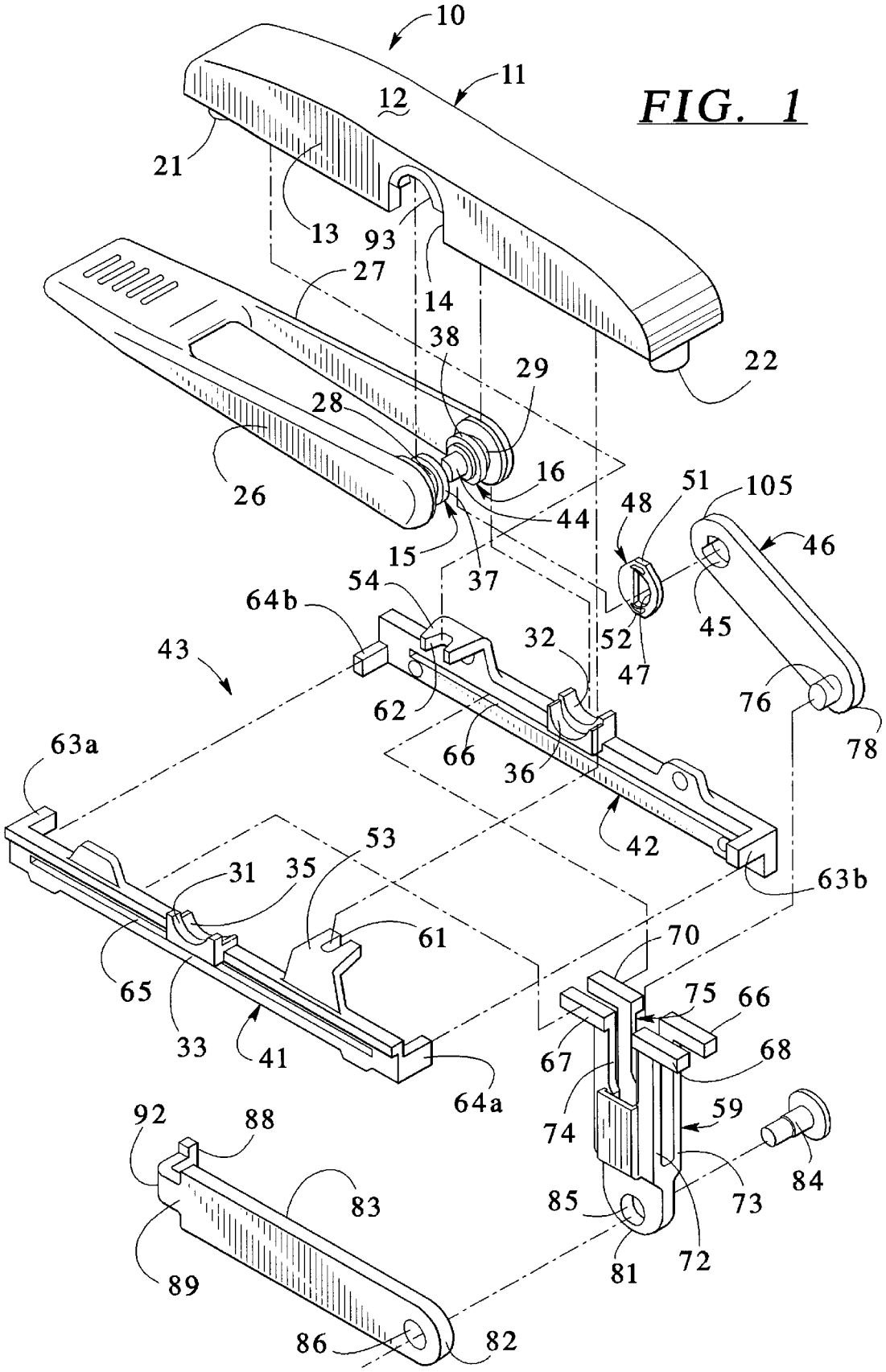
FIG. 1 is an exploded perspective view of a multi-point lock operator made in accordance with the present invention.

Turning to FIG. 1, the operator 10 of the present invention includes an escutcheon 11 which features a smooth, continuous outer wall 12 disposed between two side walls, only one of which is shown at 13 in FIG. 1. The side wall 13 includes a slot 14 for accommodating the shaft 15 of the handle 16*a*. The other shaft 16 being accommodated in the slot 17 disposed in the side wall 18 of the escutcheon 11 as shown in FIG. 2.

Figure 2:
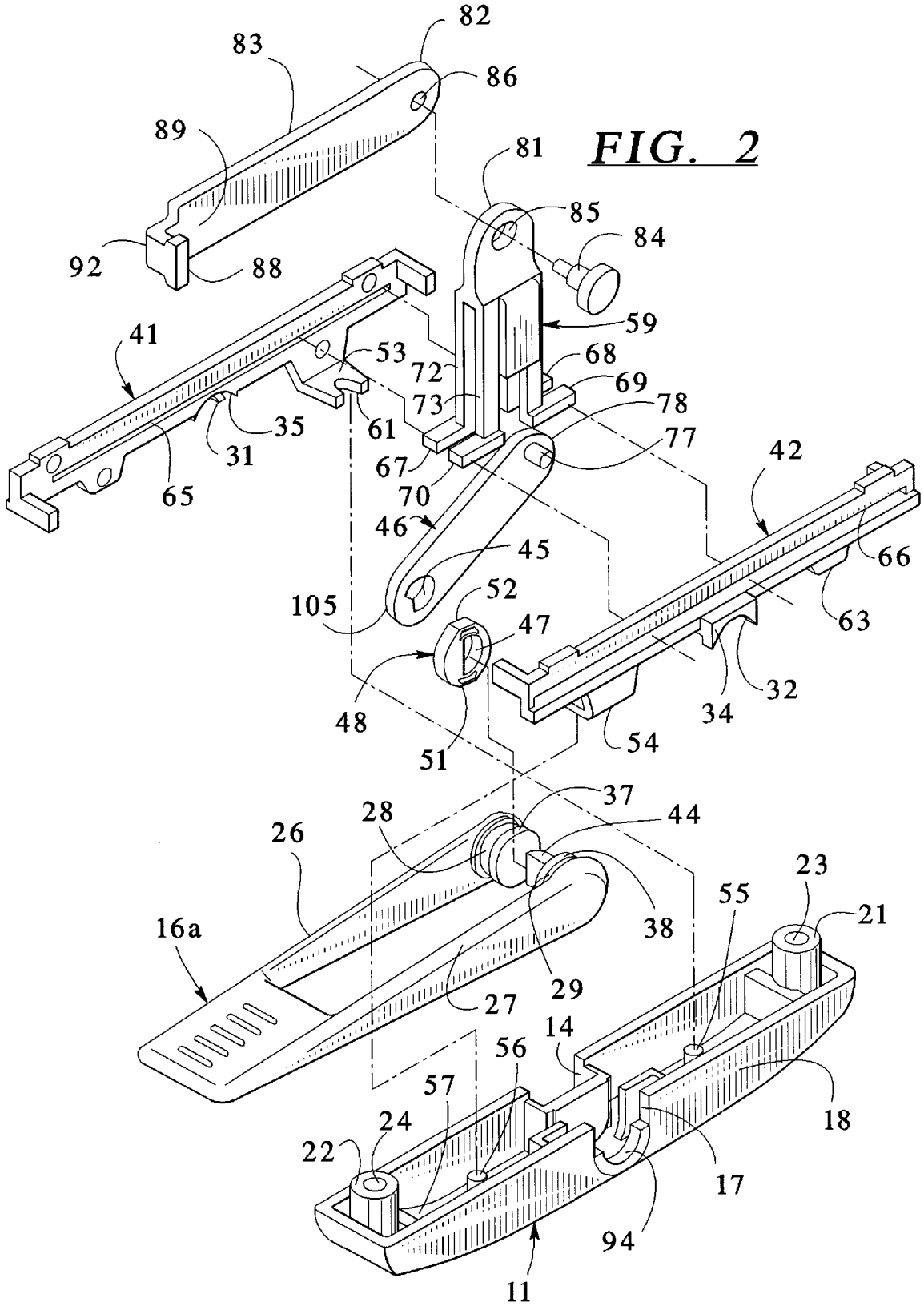
FIG. 2 is another exploded view of the multi-point lock operator shown in FIG. 1, in an inverted position.
Figures 3, 4:
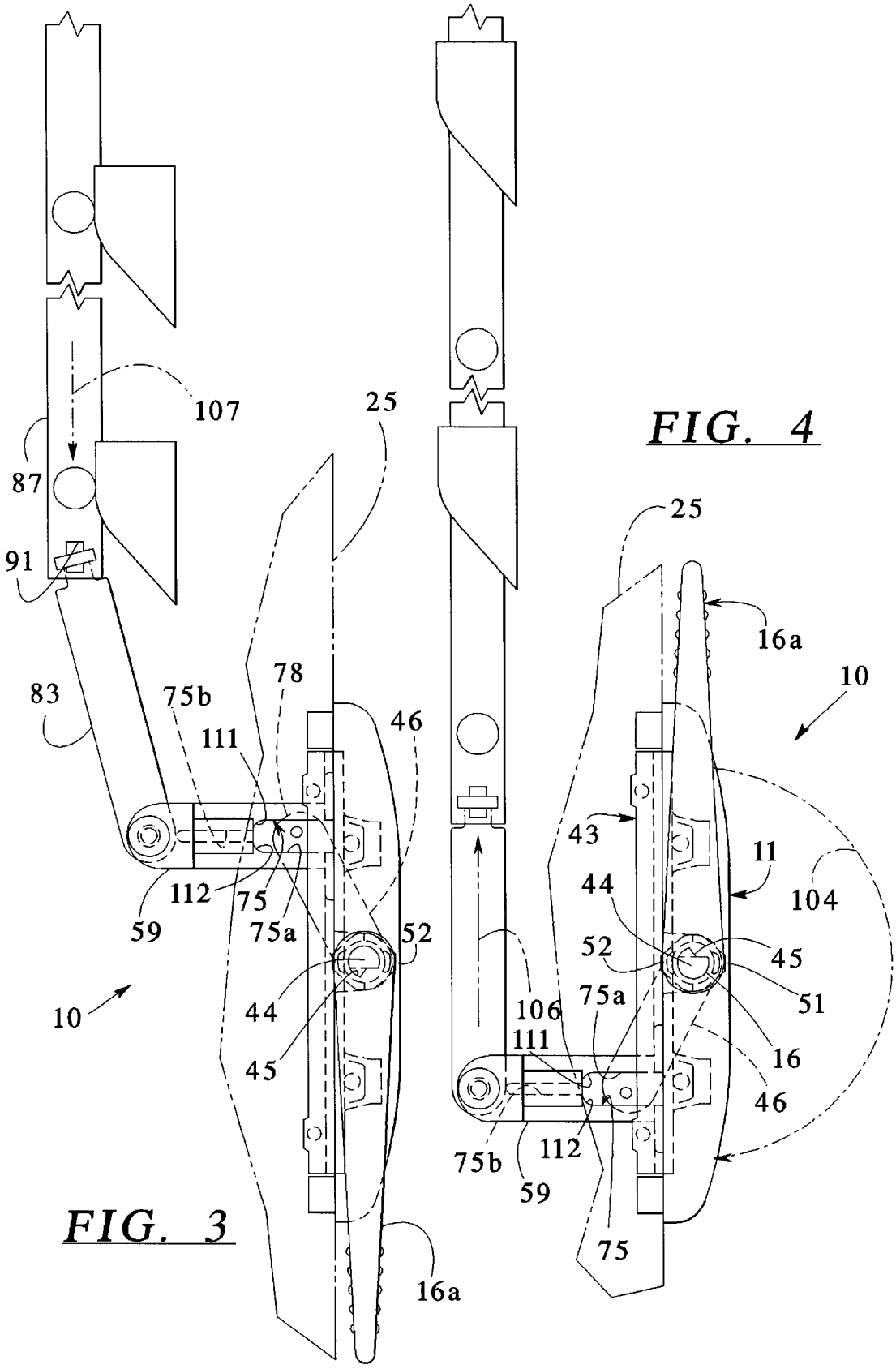
FIG. 3 is a side elevational view of the multi-point lock operator shown in FIG. 1 in a locked or closed position.
FIG. 4 is a side elevational view of the multi-point lock operator shown in FIG. 1 in an open or unlocked position.

Returning to FIG. 1, the escutcheon 11 also includes downwardly extending supports 21, 22 which, as shown in FIG. 2, include centrally disposed holes 23, 24 which accommodate screws (not shown) for fastening the escutcheon 11 to an inside surface 25 of a window frame (see FIGS. 3 and 4).

Still referring to FIG. 1, the handle 16*a* includes two opposing and parallel legs 26, 27. The distal ends of the legs 26, 27 are attached to the shafts 15,16. The shafts 15, 16 each include a groove shown at 28 and 29 respectively. The grooves 28, 29 receive the outer straddle sections 31, 32 of the braces 33, 34 respectively. Each brace 33 and 34 also includes an inner straddle section shown at 35, 36 which engages a hub 37 of the shaft 15 or a hub 38 of the shaft 16 respectively. The combination of the engagement of the hubs 37, 38 in the inner straddle sections 35, 36 with the reception of the outer straddles 31, 32 in the grooves 28, 29 provides a suitable tongue-in-groove type connection which provides structural stability to the legs 26, 27 of the handle 16*a* and prevents the legs 26, 27 from being dislodged from the braces 33, 34 respectively. Also, the above-described tongue-in-groove type connection results in a suitable seal between the handle 16, the escutcheon 11 and side members 41, 42 of the base 43.

Still referring to FIG. 1, the end 44 of the shaft 16 passes through a shaped hole 45 in the first link 46. As shown in FIGS. 2, 3 and 4, the end 44 of the shaft 16 has a semi-circular cross section. In contrast, the shaped hole 45 of the first link 46 has a non-circular shape that is larger than the semi-circular cross section of the end 44 of the shaft 16. Because the hole 45 is larger than the end 44 of the shaft 16, the handle 16*a* may be rotated a limited amount without imparting rotation to the first link 46. The importance of this delayed movement of the first link 46 in response to rotational movement of the handles 16*a* will be discussed further below.

Still referring to FIG. 1, the end 44 of the shaft 16 passes through a semi-circular hole 47 of a washer 48. The outer periphery of the washer features two flat portions shown at 51, 52. Referring briefly to FIGS. 3 and 4, the flat portion 51 engages in underside the escutcheon 11 when the handle 16*a* is in the open position as shown in FIG. 4. In contrast, the flat surface 52 engages the underside of the escutcheon 11 when the handle 16*a* is rotated to the closed or locked position as shown in FIG. 3. The engagement between the flat surfaces 51, 52 and the underside 57 of the escutcheon 11 (see FIG. 2) results in a frictional biasing of the handle 16*a* in either the opened or unlocked position shown in FIG. 4 or the closed or locked shown in FIG. 3. Thus, the cooperation between the flat surfaces 51, 52 of the washer 48 and the underside 57 of the escutcheon 11 provides a signal to the user of the lock 10 that the lock 10 is either in the open (FIG. 4) or locked (FIG. 3) position. Further, the engagement between the flat surface 51 of the washer 48 and the underside 57 of the escutcheon 11 prevents the handle 16*a* from rotating out of the open position. This feature is desirable because consumers prefer window hardware that has a low profile and that is less noticeable than hardware having a higher profile and with handles or levers that stick outward from the window frame or wall.

Returning to FIG. 1, the base 43 consists of two side members 41, 42 that are joined to form a frame which defines a central slot through which the first link 46 and plate member 59 extend. Each side member 41, 42 includes an upper tab 63*a*, 63*b* respectively which overlies a lower tab 64*a*, 64*b* respectively of the opposing side member. The side members 41, 42 also preferably include brackets like those shown at 53, 54 for accommodating the pins 55, 56 attached to the underside 57 of the escutcheon 11 as shown in FIG. 2. The pins shown at 55, 56 in FIG. 2 frictionally engage the slots shown at 61, 62 in the brackets 53, 54. Each side member 41, 42 also includes a track shown at 65, 66 respectively. The tracks 65, 66 accommodate the ledges shown at 67, 68 and 69, 70 respectively. The accommodation of the ledges 67, 68 and the track 65 as well as the accommodation of the ledges 69, 70 in the track 66 supports the plate member 59 and permits the sliding movement of the plate member 59 from the closed position shown in FIG. 3 to the open position shown in FIG. 4. Still referring to FIG. 1, the plate member 59 features two parallel walls 72, 73. Each parallel walls 72, 73 includes a slot 74, 75 respectively. The slots 74, 75 accommodate one of the two sliders 76 (see FIG. 1) or 77 (see FIG. 2) disposed at a distal end 78 of the first link 46.

Still referring to FIG. 1 a distal end 81 of the plate member 59 is attached to a proximate end 82 of a second link 83 by a pin or suitable fastener 84. The pin 84 passes through hole 85 disposed in the distal end 81 of the plate member 59 and through the hole 86 disposed in the proximate end 82 of the second link 83. The second link 83, in turn, is pivotally connected to a tie bar 87 as shown in FIGS. 3 and 4. A flange shown at 88 is provided at a distal end 89 of the second link 83 which fits through the elongated slot 91 disposed in the end of the tie bar 87. The narrow portion 92 of the second link 83 is free to pivot within the slot 91 of the tie bar 87.

Referring to FIGS. 1 and 2 collectively, it will be noted that the slot 14 includes an arch 93 which is accommodated in the groove 28 of the shaft 15. Similarly, referring to FIG. 2, the slot 17 includes an arch 94 which is accommodated in the groove 29 of the shaft 16. The tongue-in-groove relationship between the arch 93 and groove 28 complements the tongue-in-groove relationship between the outer straddle section 31 of the brace 33 and the groove 28 to provide structural stability to the connection between the legs 26, 27 of the handle 16*a* and the escutcheon 11 and also to provide a suitable seal between the leg 26 of the handle 16*a*, the escutcheon 11 and the side member 41. Similarly, the tongue-in-groove relationship between the arch 94 and the groove 29 complements the tongue-in-groove relationship between the groove 29 and the outer straddle section 32 of the brace 34 to the aforenoted structural stability and to provide a suitable seal between the leg 27 of the handle 16*a*, the escutcheon 11 and the side member 42.

Referring to FIGS. 5 through 7, the washer 48 is shown in detail. The slots shown at 95, 96 permit the washer 48 to be slightly compressible when the flat surface 51 engages the underside 57 of the escutcheon 11 as shown in FIG. 4 or when the flat surface 52 engages the underside 57 of the escutcheon 11 as shown in FIG. 3. If the washer is fabricated from a material that is too rigid, it will not be flexible enough to provide the requisite resiliency. On the other hand, if the washer 48 is fabricated from a material that is too soft or resilient, premature wear may result or the washer may fail to provide the requisite biasing force on the handle 16. Accordingly, by providing the slots 95, 96 in the washer 48, a fairly rigid material may be used which will be sufficiently resilient with the placement of the slots 95, 96 below the flat surfaces 51, 52 respectively.

Turning to FIG. 8, in an embodiment of the present invention, an engagement between the sliders 76, 77 of the distal end 78 of the first link 46 and receiving areas disposed at the lower end of the slots 74, 75 of the plate member 59 provide additional security against the lock 10 being picked. Specifically, the slot 74 includes a wider upper portion 74*a* and a narrower lower portion 74*b*. The transition area between the wider upper portion 74*a* and the narrower lower portion 74*b* features two curved receiving areas 101, 102. As illustrated in FIG. 8, these curved receiving areas engage the slider 76 and interfere with the movement of the slider 76 between the wider upper portion 74*a* and the narrower lower portion 74*b*. This interference in the movement of the slider 76 and therefore the link 46 by the curved receiving area 102 as shown in FIG. 8 provides a pick-proof feature as follows. Specifically, referring to FIG. 3, if an intruder attempts to pick the lock from the exterior of the building, the intruder would attempt to force a blade or tool in between the window sash and frame and push the plate member 59 downward from the prospective shown in FIG. 3. By attempting to move the plate member 59 downward, the intruder would be attempting to move the lock from the position shown in FIG. 3 to the position shown in FIG. 4. However, this downward movement is precluded by the engagement of the slider 76 in the curved receiving area 102 as shown in FIG. 8. A similar interference engagement is provided between the slider 77 of the link 46 (see FIG. 2) and the curved receiving area shown at 111 in FIG. 3. Also shown in FIGS. 3 and 4 is the slot 75 with its wider upper end 75*a* and narrower lower end 75*b* with the curved receiving areas 111,112 disposed therebetween.

Referring to FIG. 4, the lock 10 is shown in an open position. The handle 16*a* is disposed in a position that is substantially parallel to the base 43 and the inside surface 25 of the window frame. The grip portion 103 of the handle 16*a* is also disposed adjacent to the frame surface 25. Upon rotation of the handle 16*a* downward in the direction of the arrow 104, the end 44 of the shaft 16 will also rotate in the direction of the arrow 104 and will eventually engage the shaped hole 45 disposed at the proximate end 105 of the first link 46. The first link 46 will continue to rotate in the direction of the arrow 104 and will eventually cause the plate member 59 to move vertically upward in the direction of the arrow 106 towards the locked position shown in FIG. 3.

Referring now to FIG. 3, to unlock the operator 10, the handle 16*a* is lifted upward and the end 44 of the shaft 16 begins to rotate within the shaped hole 45. After the delay, the end 44 engages the hole 45 which results in a rotation of the first link 46 in the downward direction as shown in FIG. 3 and toward the position of the first link 46 shown in FIG. 4. This motion will result in the tie bar 87, second link 83 and plate member 59 moving downward in the direction of the arrow 107 shown in FIG. 3 towards the position shown in FIG. 4. The delayed provided by the shaped hole 45 in the first link 46 and the semi-circular shape of the end 44 of the shaft 16 enables the handle 16*a* to be rotated a full 180° as shown in FIG. 4 while actually rotating the first link 46 through an angle of less than 180°. Thus, the delay enables the handle 16*a* to assume a flat position with respect to the inside window frame surface 25 when the lock is in either the unlocked position as shown in FIG. 4 or locked position as shown in FIG. 3.

Finally, another feature of the present invention is the aesthetic look of the escutcheon 11/handle 16*a* combination from the inside of the building or structure.

Figure 9:
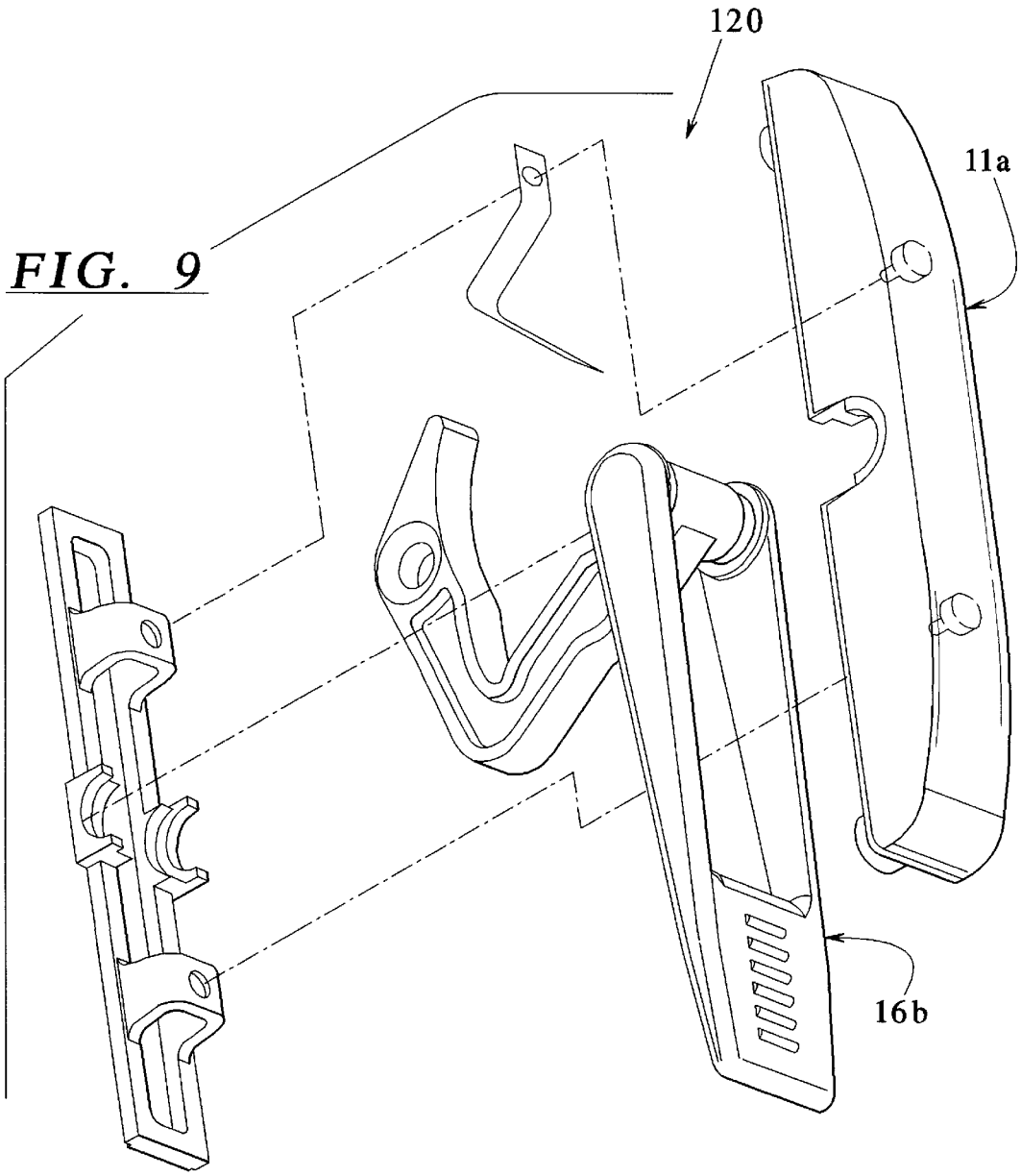
FIG. 9 is an exploded view of a single-point operator utilizing the escutcheon and handle design of the multi-point operator of the present invention.

Specifically, the operator 10 is symmetrical in appearance and can be used on either side of the window or one operator can be used in a position adjacent to another operator without any indication that one of the operators is left-handed and the other operator is right-handed. Further, the operator 10 has a very low profile which satisfies the aesthetic needs of consumers and designers. Still further, the multi-point operator 10 has the same appearance as an equivalent single-point operator which can be provided with the same escutcheon 11/handle 16*a* design. An example of a single point operator that incorporates an escutcheon 11 a with the same exterior appearance as the escutcheon 11 of the operator 10 of the present invention and a handle 16*b* with the same exterior appearance as the handle 16*a* of the operator 10 of the present invention is shown in FIG. 9. As shown in co-pending design patent application Ser. No. 29/065,244, which is incorporated herein by reference, the top plan views and bottom plan views of the multi-point operator 10 shown in FIGS. 1–8 and the single point operator 120 shown in FIG. 9 are the same.

Accordingly, an improved multi-point window lock operator is provided which assumes flat profile in both the open the closed positions, which provides an effective seal against the inside window frame surface and which can be used on either the right side or left side of a window frame. The multi-point operator of the present invention can be fabricated from molded or die cast parts and can further be equipped with a gasket disposed between the escutcheon and the window frame surface. The operator of the present invention also provides a pleasant snap biased feel when the handle is moved into either the unlocked or locked positions.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

It is claimed:

1. A sash lock comprising:

a base comprising an elongated frame defining a central slot, the frame further comprising a pair of parallel side members disposed on opposing sides of the slot, each side member comprising a brace, each side member further comprising a track that extends along an inside surface thereof, the braces supporting a handle for pivotal movement between an open and a closed position, the handle comprising a pair of opposing legs, each opposing leg comprising a distal end having an inwardly extending shaft, the inwardly extending shaft of each leg being supported by one of the braces, at least one of the shafts of one of the legs of the handle being connected to a proximate end of a first link that extends through the central slot, the first link comprising a distal end that comprises a pair of outwardly extending sliders; the distal end of the link being accommodated between the walls of a dual-walled plate member, each wall of the dual-walled plate member comprising a downwardly extending slot for accommodating one of the sliders of the link, a proximate end of the plate member comprising a pair of outwardly directed ledges, each ledge being slidably accommodated in one of the tracks of the side members of the frame, the dual-walled plate member further comprising a distal end that is pivotally connected to a second link.

2. The lock of claim 1 wherein the frame further comprises at least one bracket for connecting the frame to an escutcheon, at least a portion of the escutcheon being disposed between the opposing legs of the handle.

3. The lock of claim 2 further comprising a washer through which the shaft of the leg that is connected to the first link passes, the washer comprising an outer periphery, the outer periphery comprising two diametrically opposed flat surfaces, one of the flat surfaces engaging an underside of the escutcheon and biasing the lock into the closed position, the other of the flat surfaces engaging the underside of the escutcheon and biasing the lock into an open position.

4. The lock of claim 1 wherein the escutcheon further comprises two opposing sides, each side comprising a slot through which one of the inwardly directed shafts extends.

5. The lock of claim 1 wherein the shaft of the leg of the handle that is connected to the proximate end of the first link comprises a cammed outer peripheral surface, the shaft passing through a non-circular hole in the proximate end of the first link, the lock further comprising a clearance between the outer peripheral surface of the shaft and the non-circular hole of the first link.

6. The lock of claim 1 wherein the shaft of the leg that is connected to the proximate end of the first link comprises a cammed outer peripheral surface having at least one flat surface, the proximate end of the first link comprising a non-circular hole through which the shaft passes, the lock further comprising a clearance between the non-circular hole of the first link and the shaft passing through the hole, rotation of the handle causing a delayed engagement between the flat surface of the shaft and the hole thereby resulting in a delayed rotation of the first link.

7. The lock of claim 1 wherein the shaft of the leg of the handle that is connected to the proximate end of the first link comprises a semi-circular cross section, the proximate end of the link comprising a non-circular hole through which the shaft passes.

8. The lock of claim 1 wherein each slot of each wall of the dual-walled plate member comprises a wider upper end and a narrower lower end at least one curved receiving area disposed therebetween, the curved receiving areas interfering with the movement of the sliders of the first link and preventing movement of the dual walled plate member along the base of the lock from the closed position towards the open position under pressure imposed on the plate member from a point disposed underneath the base when the lock is in the closed position.

9. The lock of claim 1 wherein the base further comprises two mating halves, each mating half comprising one of the braces and one of the tracks.

10. The lock of claim 1 wherein the dual-walled plate member further comprises four ledges, two ledges being disposed in each of said tracks.

11. The lock of claim 10 wherein the grip comprises a flat member that is disposed substantially parallel to the base when the lock is in the closed position.

12. The lock of claim 11 wherein the flat member further comprises a plurality of upwardly protruding grip members.

13. The lock of claim 10 wherein the grip comprises a flat member that is disposed substantially parallel to the base when the lock is in an open position.

14. The lock of claim 1 wherein the handle further comprises a grip portion that connects the legs at proximate ends thereof.

15. An operator for a multi-point locking system for a window sash, the locking system including a tie bar that moves upward and downward between closed and open positions, the operator comprising:

a base comprising an elongated frame defining a central slot, the frame further comprising a pair of parallel side members disposed on opposing sides of the slot, each side member comprising a brace, each side member further comprising a track that extends along an inside surface thereof, the braces supporting a handle for pivotal movement between an open and a closed position, the handle comprising a pair of opposing legs, each opposing leg comprising a distal end having an inwardly extending shaft, the inwardly extending shaft of each leg being supported by one of the braces, at least one of the shafts of one of the legs of the handle being connected to a proximate end of a first link that extends through the central slot, the first link comprising a distal end that pivotally and slidably engages a plate member, the plate member comprising a downwardly extending slot for accommodating the distal end of the link, a proximate end of the plate member comprising a pair of outwardly directed ledges, each ledge being slidably accommodated in one of the tracks of the side members of the frame, the plate member further comprising a distal end that is pivotally connected to a second link.

16. The lock of claim 15 wherein the frame further comprises at least one bracket for connecting the frame to an escutcheon, at least a portion of the escutcheon being disposed between the opposing legs of the handle.

17. The lock of claim 16 further comprising a washer through which the shaft of the leg that is connected to the first link passes, the washer comprising an outer periphery, the outer periphery comprising two diametrically opposed flat surfaces, one of the flat surfaces engaging an underside of the escutcheon and biasing the lock into the closed position, the other of the flat surfaces engaging the underside of the escutcheon and biasing the lock into an open position.

18. The lock of claim 15 wherein the shaft of the leg that is connected to the proximate end of the first link comprises a cammed outer peripheral surface having at least one flat surface, the proximate end of the first link comprising a non-circular hole through which the shaft passes, the lock further comprising a clearance between the non-circular hole of the first link and the shaft passing through the hole, rotation of the handle causing a delayed engagement between the flat surface of the shaft and the hole thereby resulting in a delayed rotation of the first link.

19. The lock of claim 15 wherein the slot of the plate member comprises a wider upper end and a narrower lower end with a curved receiving area disposed therebetween, the curved receiving area interfering with the movement of the distal end of the first link and preventing movement of the plate member along the base from the closed position towards the open position under pressure imposed on the plate member from a point underneath the base when the lock is in the closed position.

20. A sash lock comprising:

a base comprising an elongated frame defining a central slot, the frame further comprising a pair of parallel side members disposed on opposing sides of the slot, each side member comprising a brace, each side member further comprising a track that extends along an inside surface thereof, the frame further comprises at least one bracket for connecting the frame to an escutcheon, the braces supporting a handle for pivotal movement between an open and a closed position, the handle comprising a pair of opposing legs, each opposing leg comprising a distal end having an inwardly extending shaft, the inwardly extending shaft of each leg being supported by one of the braces, at least one of the shafts of one of the legs of the handle being connected to a proximate end of a first link that extends through the central slot, at least a portion of the escutcheon being disposed between the opposing legs of the handle, the shaft of the leg that is connected to the first link passing through a washer, the washer comprising an outer periphery, the outer periphery comprising two diametrically opposed flat surfaces, one of the flat surfaces engaging an underside of the escutcheon and biasing the lock into the closed position, the other of the flat surfaces engaging the underside of the escutcheon and biasing the lock into an open position, the shaft of the leg that is connected to the proximate end of the first link further comprising a cammed outer peripheral surface having at least one flat surface, the proximate end of the first link comprising a non-circular hole through which the shaft passes, the lock further comprising a clearance between the non-circular hole of the first link and the shaft passing through the hole, rotation of the handle causing a delayed engagement between the flat surface of the shaft and the hole in the first link thereby resulting in a delayed rotation of the first link upon rotation of the handle, the first link further comprising a distal end that comprises a pair of outwardly extending sliders, the distal end of the link being accommodated between the walls of a dual-walled plate member, each wall of the dual-walled plate member comprising a downwardly extending slot for accommodating one of the sliders of the link, each slot of each wall of the dual-walled plate member comprising at least one curved receiving area for accommodating one of the sliders of the first link and interfering with movement of the dual-walled plate member along the base from the closed position towards the open position under pressure imposed on the dual-walled plate member from a point disposed below the base, a proximate end of the plate member comprising a pair of outwardly directed ledges, each ledge being slidably accommodated in one of the tracks of the side members of the frame, the dual-walled plate member further comprising a distal end that is pivotally connected to a second link.

* * * * *